US006557897B1

(12) United States Patent
Gaudet

(10) Patent No.: US 6,557,897 B1
(45) Date of Patent: May 6, 2003

(54) COLLAPSIBLE STAND ESPECIALLY FOR BINDERS

(76) Inventor: Ronald F. Gaudet, Suite 105 1817 Victoria Diversion, Vancouver, B.C. (CA), V5N 2K2

( * ) Notice: Subject to any disclaimer, the term of this patent is extended or adjusted under 35 U.S.C. 154(b) by 0 days.

(21) Appl. No.: 09/988,501

(22) Filed: Nov. 20, 2001

(51) Int. Cl.[7] ..... A47B 23/00
(52) U.S. Cl. ..... 281/33; 248/455
(58) Field of Search ..... 281/15.1, 21.1, 281/33, 29, 36, 37, 43, 51; 402/70, 73, 80 R; 248/441.1, 455, 457, 460

(56) References Cited

U.S. PATENT DOCUMENTS 2,558,931 A * 7/1951 Chase ..... 281/33
3,261,119 A * 7/1966 King ..... 281/33
4,607,817 A * 8/1986 Aquino ..... 248/459
6,010,158 A * 1/2000 Croteau ..... 281/33

* cited by examiner

*Primary Examiner*—Willmon Fridie, Jr.

(57) ABSTRACT

A one-piece collapsible stand, especially for a binder, made of a suitable material, like corrugated cardboard or polypropylene, by stamping or molding. In its collapsed configuration, all components of the stand are coplanar. The stand comprises a frame-like bottom plate, to which a center leg and two side legs are connected by integral hinges. Complementary latch notches in the side of the engaging legs adjacent their free ends interlock to fix the structure in its erected configuration. Specifically spaced circular holes aligned in parallel to a side of the frame-like bottom plate enable the stand to be transported in its collapsed position in ring binders.

22 Claims, 3 Drawing Sheets

COLLAPSIBLE STAND ESPECIALLY FOR BINDERS

BACKGROUND OF THE INVENTION

The invention relates to a collapsible stand, especially for binders or other material, which are to be held in a convenient position for reading. Although below the device according to the invention is referred to as a binder stand, it should clearly be understood that the stand can be used for other purposes, e.g. for the storage or display of books, brochures, manuals, loose pages, and other substantially flat materials U.S. Class: Class 248: which provides for devices which carry the weight of an article or articles against the pull of gravity/subclass 459: which provides for devices formed from a sheet or blank of cardboard or equivalent material, which can be bent and, which, when assembled, provides stable support for said article or articles.

Other stands made for binders are designed either to provide a portable writing stand, or they are combination ring binders and stands; in one instance, the stand is also an outer case for a ring binder. None of the stands turned up in a search of existing patents offer a simple, portable, inexpensive stand for binders. Some bookstands may also be capable of supporting a binder, and may be portable, but they must be carried independently of the binder and, consequently, take up more room and are not as convenient as the design in this patent application.

BRIEF SUMMARY OF THE INVENTION

It is an object of the invention to provide a one-piece collapsible binder stand made of lightweight material by stamping or molding, and to arrange the structural members in such a way that heavy binders and books can be safely supported by a simple structure, which is easy and inexpensive to manufacture, and can be easily inserted in a ring binder for secure and convenient transportation.

The invention relates to a one-piece collapsible stand, especially for a binder, made of a suitable material by stamping or molding, the stand being foldable between an erected, operative configuration and a collapsed, inoperative configuration wherein all of its components are coplanar, and it can be easily inserted in a binder. The stand comprises a frame-like bottom plate having a front edge portion and a rear edge portion; a center leg having two sides and a free end and being connected to the front edge portion by an integral hinge; one side leg on each side of the center leg, each side leg having an inner side, and outer side, and a free end, and being connected to the rear portion by an integral hinge; latch notches on each side of the center leg adjacent the free end of each side leg; and two cover tabs for preventing the article to be supported from sliding off the stand, each cover tab having two sides, and an elliptical free end, and being connected to the front edge portion by an integral hinge; and two page tabs for holding the pages, each page tab having two sides, and an elliptical free end, and being connected to the front portion by an integral hinge; and circular openings aligned in parallel to a side of the frame-like bottom plate for the purpose of inserting the stand into the rings of a binder, like a loose-leaf page, to provide means for transporting the stand with a binder. All integral hinges have their pivotal axis formed by a line of reduced thickness of the material. The engaging sides of the legs are formed such that the latch notches interlock for fixing the legs in the erected, operative configuration.

DETAILED DESCRIPTION OF THE INVENTION

Figure 1:
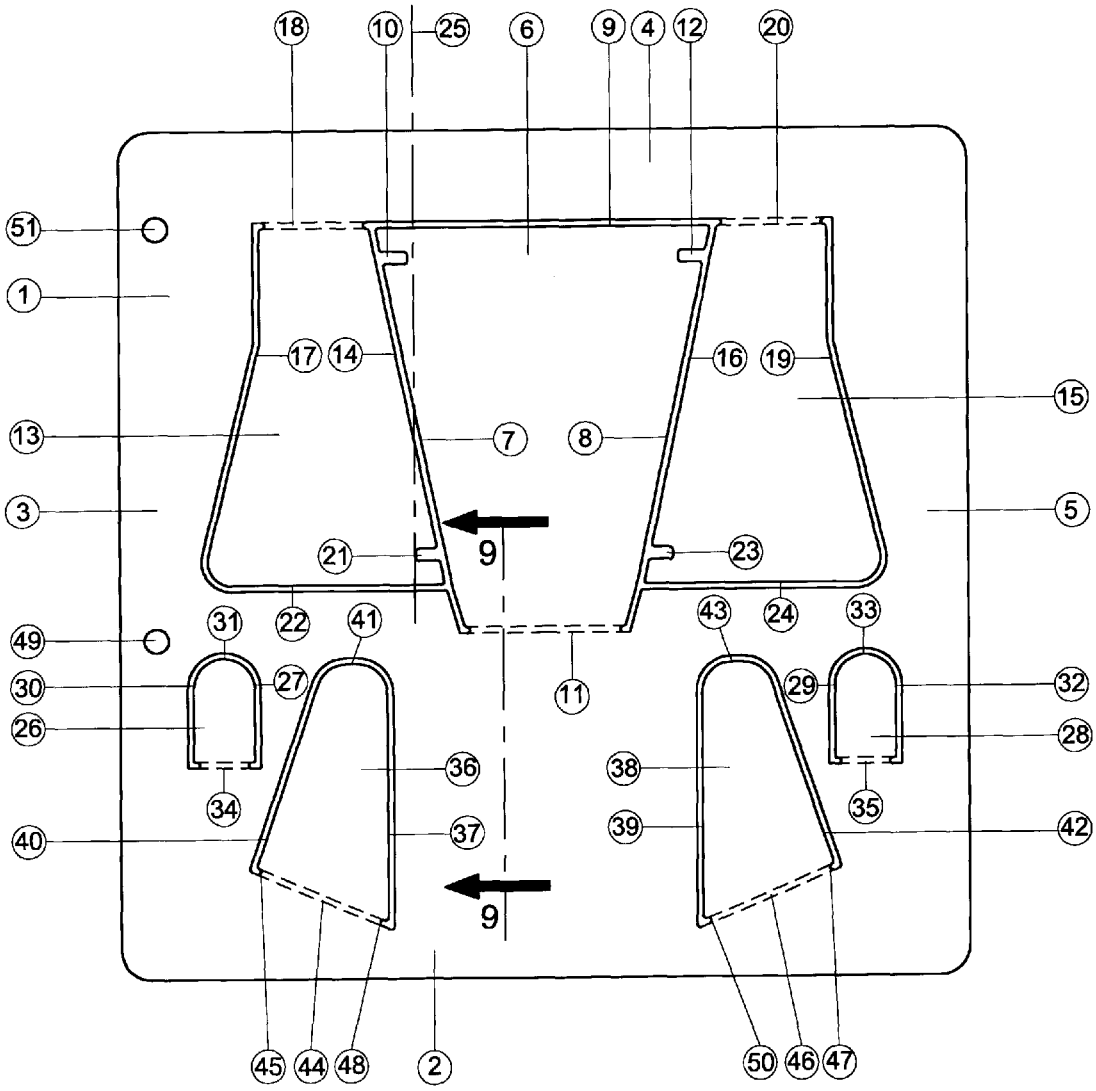
FIG. 1 is a top plan view of a binder stand according to the invention, the stand being shown in its collapsed, inoperative configuration.
Figure 2:
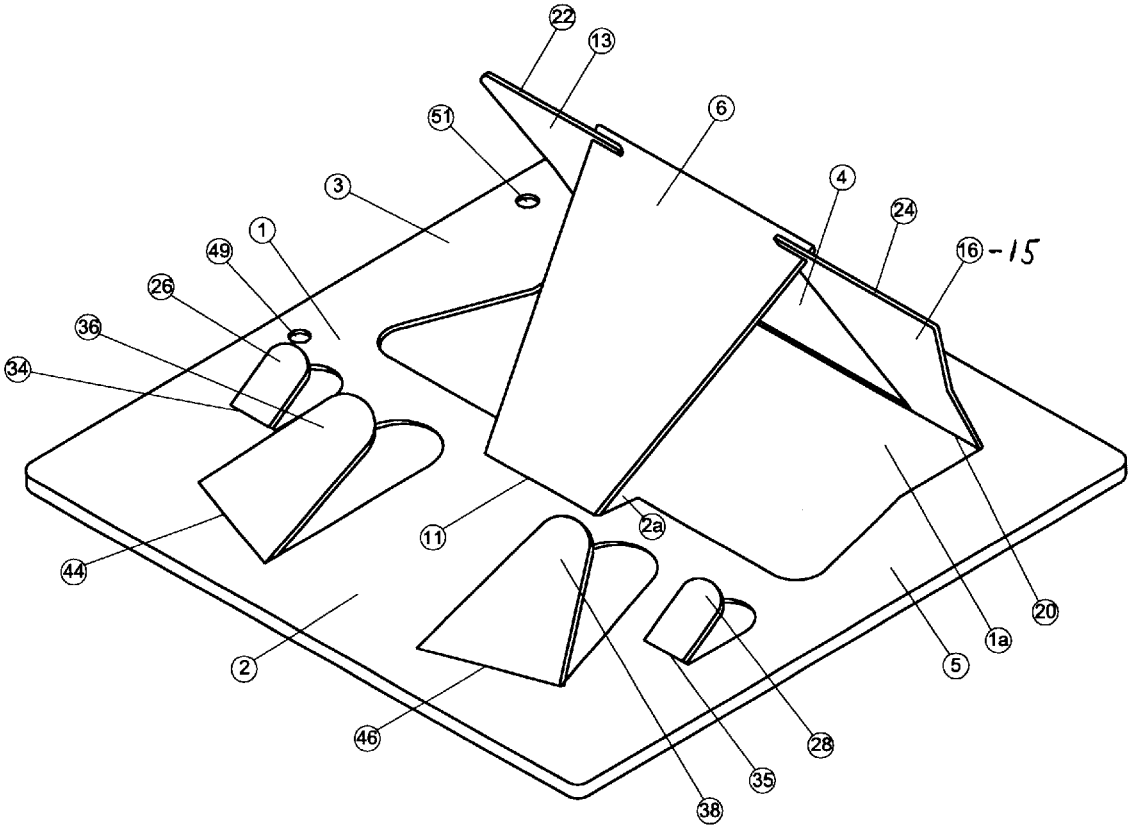
FIG. 2 is a perspective view of the binder stand of FIG. 1 shown in its erected, operative configuration.

The stand shown in FIGS. 1 and 2 is made of a material that can be stamped or molded and that has the property of being bendable for a considerable number of times along lines of reduced thickness without showing fatigue failure. Corrugated cardboard and polypropylene are examples of such materials that lend themselves to forming integral hinges as further described below.

Figure 3:
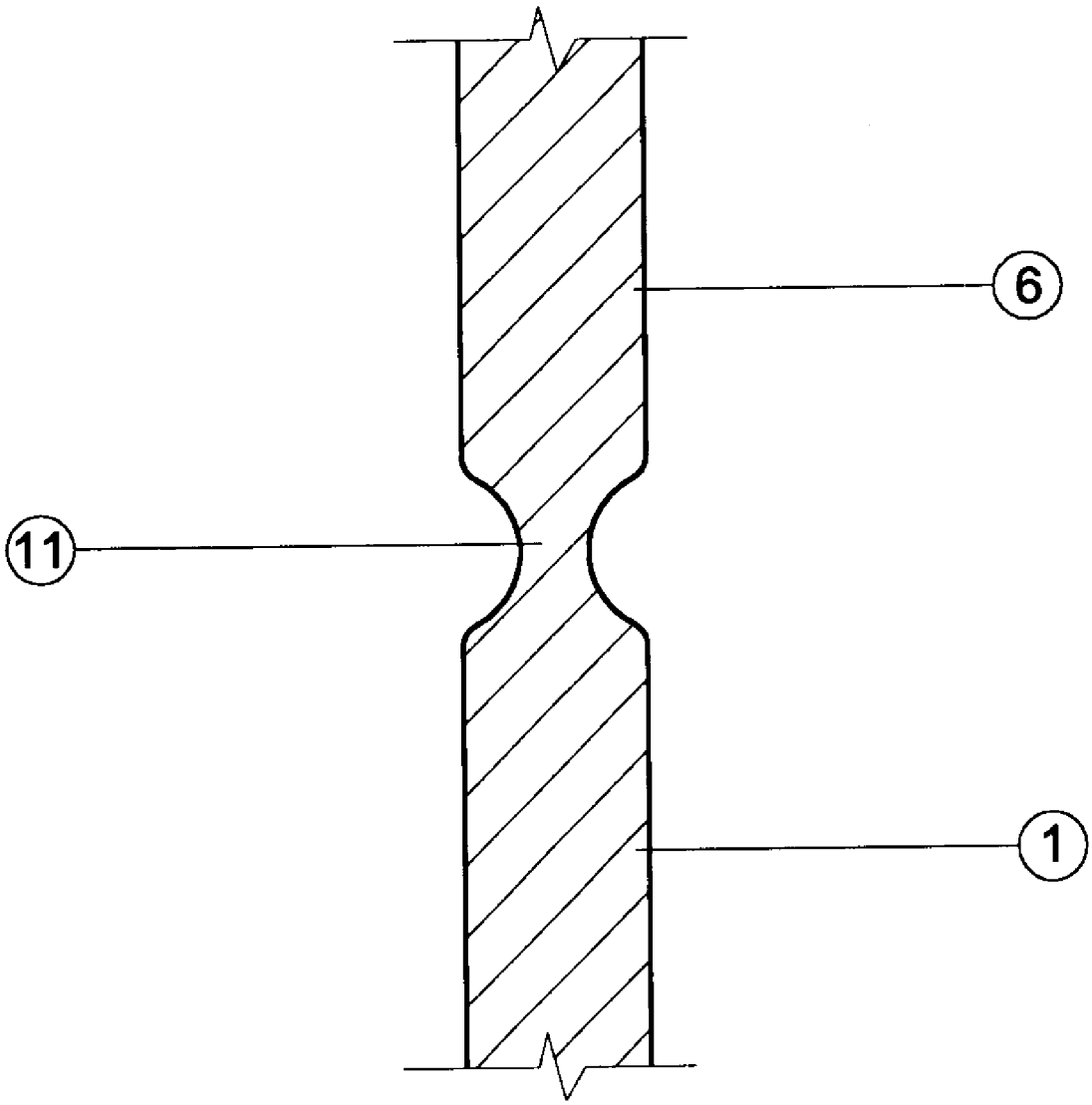
FIG. 3. shows an integral hinge in fragmented cross section along the lines 9—9 in FIG. 1

In its collapsed configuration, the stand resembles a flat sheet of material with cut lines as shown. The stand comprises a bottom plate 1 having a front edge portion 2, a rear edge portion 4 and two side edge portions 3 and 5 extending between the front and rear edge portions to form a closed, generally rectangular base. Circular openings are formed either by stamping or molding along a side of plate 1 (e.g. 49 and 51). These circular openings are generally aligned with each other and are generally disposed parallel to a side of plate 1. The spacing between said circular openings matches the configuration of commercially available ring binders and other binders. A generally oblong opening 1*a* is formed in bottom plate 1. The front edge portion 2 includes a central recess 2*a* contiguous with the generally oblong opening 1*a*. The central recess 2*a* extends a substantial distance into the front edge portion 2. A center leg 6 has two sides 7 and 9 and a free end 8. Central leg 6 is hingedly connected to a front edge of central recess 2*a* forming a central hinge 11. The hinge 11 is an area of reduced thickness obtained by grooving the material on both sides to serve as an integral central hinge 11 as shown in cross section in FIG. 3 and in broken lines in FIG. 1. Two side legs 13 and 15 are similarly connected to bottom plate 1 adjacent the rear edge portion 4 by integral side hinges. The hinges 18 and 20 are generally aligned with each other and are generally parallel to the hinge 11. The legs 13 and 15 have respective inner sides 14 and 16, outer sides 17 and 19, and free ends 22 and 24. The side edges 7 and 9 of the central leg 6 are inclined obliquely to the central hinge 11 at an angle other than a right angle. As shown, the edges 7 and 9 diverge from the central hinge 11 towards the free end 8 to produce an inversely tapered center leg in which the free end 8 is wider than the length of the central hinge 11. Similarly, the inner sides 14 and 16 of the side legs converge towards each other from their respective side hinges 18 and 20 to be generally adjacent the side edges 7 and 9 of the center leg. In their erected, operative configuration the legs can be interlocked by parallel latch notches 10, 21 and 12, 23 respectively. The closed ends of engaging latch notches are positioned in a common datum line 25, which is essentially at right angles to the pivotal axis of the corresponding hinge. This is shown in FIG. 1, where 10 and 21 are engaging latch notches of the center leg 7 and the side leg 13; the common line 25 is at right angles to the pivotal axis of the hinge 18. Thus a stable, easel-like support is created.

First tab means 26 and 28 are provided on the front edge portion 2 to serve for holding the covers of binder, or book, or other material to prevent the article from sliding off the stand supporting it. First tab means 26 and 28 each having two sides 27 and 30, and 29 and 32 respectively, and an elliptical free end 31 and 33, and are connected to the front edge portion by an integral hinge 34 and 35, which are in parallel to central hinge 11. First tab means 26 and 28 are generally aligned with each other and sides 27 and 30 and 29 and 32 are in parallel to side edge portions 3 and 5. First tab means 26 and 28 are located in close proximity to the side edge portions 3 and 5 respectively, to widen the span between first tab means, which improves the stability of an article being supported on the stand. These tabs can be bent upwards about the first tab hinges 34 and 35 to hold the covers of a binder and prevent it from sliding.

Second tab means 36 and 38 are provided on the front edge portion 2 on either side of the center leg 6 and inside of the first tab means 26 and 28. The second tab means extend substantially farther towards the front portion 2 than the first tab means. Second tab means can be bent upwards about integral second tab hinges 44 and 46 to serve for holding the pages of a binder, or book, or other material. Second tab means 36 and 38 each having an inner side 37 and 39, and an outer side 40 and 42, and an elliptical free end 41 and 43, and are connected to front portion 2 by an integral hinge 44 and 46 respectively. Second tab hinge inner endpoints 48 and 50 are generally aligned with each other, and are located closer to front edge portion 2 than second tab hinge outer endpoints 45 and 47, which are generally aligned with each other. The outer sides 40 and 42 are at a right angle to the second tab hinges 44 and 46 and the inner sides 37 and 39 are not at a right angle to the second tab hinges so that the sides converge and the inner sides 37 and 39 are longer than the outer sides 40 and 42, and the width of second tab means 36 and 38 is narrower at the free end of the tab than the width at the hinged end of the tab.

With the stand according to the invention erected, the free ends 22 and 24 of the side legs project forward of the center leg 6 and are adapted to contact and support the covers of a binder being supported on the stand. Thus the force of the weight of a heavy binder acts mostly on the free ends 22 and 24 of the side legs 13 and 15 in the direction of the longitudinal axis of each leg. This is the direction of the greatest strength of the legs and, therefore, heavy loads can be supported on a relatively light and inexpensive structure. Also, there is very little stress on the latch notches 10, 12, 21, and 23 of the stand according to the invention, which increases its product life.

Circular openings are placed to match the spacing of rings in ring binders for the purpose of transporting the stand, in its collapsed configuration, in a secure and convenient manner in such binders. Circular openings can be formed along any of the four sides of the binder stand bottom plate without in any way impairing the functionality of the binder stand. The number of circular openings and the spacing between circular openings can vary to match the configurations of different binder types and styles available on the market.

I claim:

1. A one-piece collapsible stand which is foldable between an erected, operative configuration for supporting a binder or the like in an inclined position, and a collapsed in-operative configuration wherein the stand is flat, the stand including:

(a) a frame-like bottom plate having a front edge portion, a rear edge portion, and two side edge portions extending between the front and rear edge portions to form a closed, generally rectangular base, (b) said bottom plate when said stand is erected having a generally oblong opening including front, rear and side edges, (c) said front edge of said generally oblong opening when said stand is erected having a central recess extending a substantial distance into said front edge portion, (d) said central recess having side edges and a front edge, (e) a center leg having two sides and a free end and being connected to said front edge of said central recess by an integral hinge, said center leg being adapted to fit within the bottom plate when folded flat, each side of the center leg having a central latch notch adjacent the free end of said center leg, each latch notch having a respective closed end positioned on a respective datum line disposed essentially at right angles to said central hinge, (f) two side legs disposed on opposite sides of said center leg, each side leg having an inner side, an outer side, and a free end, and being connected to said rear portion by an integral side hinge spaced from said central hinge, said inner side of each side leg being generally adjacent to an adjacent side to center leg when the three legs are folded flat to fit within said bottom plate, each inner side having a side latch notch adjacent said free end of said side leg, each side latch notch having a closed end positioned adjacent the respective datum line, (g) said center leg being substantially greater in length than said side legs, (h) said center leg being hingedly connected to said front edge of said central recess whereby when said legs are erected the obtuse angle formed by said center leg and said bottom plate is greater than the obtuse angle formed by said side legs and said bottom plate, (i) said side latch notches of said side legs being parallel to said central latch notches in the flat and erected positions, (j) said side latch notches and said central latch notches being parallel to said central hinge and side hinges in the flat and erected positions, (k) said side latch notches and said central latch notches being so arranged to permit engaging of said notches for holding said legs in the erected, operative configuration extending above said bottom plate, (l) said central hinge and side hinges having pivotal axes formed by lines of reduced thickness, (m) said free ends of said side legs each having a supporting edge, (n) said supporting edges of said legs being spaced a substantial distance from said notches on said side legs, (o) said center leg having a non-supporting edge parallel to said side legs supporting edges and extending beyond said central latch notches a distance approximately equal to the distances said supporting edges of said side legs extend beyond said side latch notches whereby when said legs are erected and notched together said center leg non-supporting edge avoids interference with a binder when positioned on said stand, (p) said side legs supporting edges having a combined length extending laterally a distance greater than the length of said center leg non-supporting edge, (q) first cover tab means for preventing the binder or the like to be supported from sliding off the stand, said first cover tab means being connected to said front edge portion by an integral hinge, (r) second cover tab means for preventing the binder or the like to be supported from sliding off the stand, said second cover tab means being connected to said front edge portion by an integral hinge, (s) said first and second cover tab means being adapted to fit within the bottom plate when folded flat, (t) said first page tab means for holding the pages of the binder or the like, said first page tab means being connected to said front edge portion by an integral hinge, (u) said second page tab means for holding the pages of the binder or the like, said second page tab means being connected to said front edge portion by an integral hinge, (v) said first and second page tab means being adapted to fit within the bottom plate when folded flat, (w) circular openings in the bottom plate for inserting the stand in a ring binder when the stand is folded flat.

2. A stand as in claim 1, wherein:

(a) said supporting edges project forwardly from the center leg for directly supporting the covers of a binder supported on the stand, (b) said supporting edges each having a surface area substantially less than the surface area of the top face of said center leg, and (c) said side legs are adapted to support binders on the stand such that the force of the weight acts in the direction of a longitudinal axis of each leg.

3. A stand as in claim 1, wherein:

(a) said front edge portion includes a first opening extending through said frame-like bottom plate for receiving a first page tab means, and (b) said first opening includes front, left and right side edges, and an elliptical rear side joining the left and right sides.

4. A stand as claimed in claim 3, wherein:

(a) said front edge portion includes a second opening extending through said frame-like bottom plate for receiving a second page tab means, and (b) said second opening includes front, left and right side edges, and an elliptical rear side joining the left and right sides.

5. A stand as in claim 3, wherein:

(a) said front edge of said first opening is substantially greater in length than said rear edge of said first opening, (b) said inner side edge of said first opening forming an acute angle with said front edge of said first opening, (c) said outer edge of said first opening forming a right angle with said front edge of first second opening, and (d) said first tab means being hingedly connected to said front edge of said first opening.

6. A stand as in claim 4, wherein:

(a) said front edge of said second opening is substantially greater in length than said rear edge of said second opening, (b) said inner side edge of said second opening forming an acute angle with said front edge of said second opening, (c) said outer side edge of said second opening forming a right angle with said front edge of said second opening, and (d) said second tab means being hingedly connected to said front edge of said second opening.

7. A stand as in claim 4, wherein:

(a) said first and second page tab openings are formed equidistant and inwardly from the outermost portion of said front edge portion of said frame-like bottom plate, (b) said first and second page tab openings are substantially farther from the outermost edge of the front edge portion of said frame-like bottom plate at the outer end of the front side of the opening than at the inner end of the front side of the opening.

8. A stand as claimed in claim 1, wherein:

(a) said front edge portion includes a first opening extending through said frame-like bottom plate for receiving a first cover tab means, and (b) said first opening includes front, left and right side edges, and an elliptical rear side edge.

9. A stand as claimed in claim 8, wherein:

(a) said front edge portion includes a second opening extending through said frame-like bottom plate for receiving a second cover tab means, and (b) said second opening includes front, left and right side edges, and an elliptical rear side edge.

10. A stand as claimed in claim 8, wherein:

(a) said right and left sides of said first opening are parallel to each other and the sides are joined by an elliptical edge at the rear side of said opening, (b) said first tab means being hingedly connected to said front edge of said first opening.

11. A stand as claimed in claim 9, wherein:

(a) said right and left sides of said second opening are parallel to each other and the sides are joined by an elliptical edge at the rear side of said opening, (b) said second tab means being hingedly connected to said front edge of said second opening.

12. A stand as claimed in claim 9, wherein said first and second openings are formed equidistant and inwardly from the outermost portion of said front edge portion of said frame-like bottom plate.

13. A stand as in claim 1, wherein:

(a) said outer side of said side legs include first and second sections, (b) said second section is adjacent said free end of said side legs, (c) said second section is substantially greater in length than said first section, and (d) said first section forming an obtuse angle with said second section less than 180°.

14. A stand as claimed in claim 1, in which, when the stand is collapsed:

(a) the side edges of the center leg diverge from the central hinge towards the free end of the center leg to produce an inversely tapered center leg in which the free end is wider than the length of the central hinge, (b) the inner sides of the side legs similarly converge towards each other from their respective side hinges to be generally adjacent the side edges of the central leg.

15. A stand as claimed in claim 1, in which:

(a) the side hinges of the side legs are aligned with each other and disposed parallel to the central hinge of the outer leg.

16. A stand as claimed in claim 1, in which:

first tab means provided on the front edge portion outside of the second tab means, each first tab means being hinged to the front edge portion by an integral first tab hinge.

17. A stand as claimed in claim 16, in which the first tab hinges are disposed parallel to the central hinge of the center leg.

18. A stand as claimed in 1, further including:

(b) second tab means provided on the front edge portion on either side of the center leg, each second tab means being hinged to the front edge portion by an integral second tab hinge.

19. A stand as claimed in claim 18, in which:

(a) the second tab hinges are generally aligned with each other, (b) the second tab hinges are disposed at an angle to the central hinge of the center leg, and (c) the second tab hinges are substantially farther from the outermost edge of the front edge portion of said frame-like bottom plate at the outer end of the hinge than it is at the inner end of the hinge.

20. A stand as claimed in claim 1 wherein the first opening for receiving cover tab means is disposed outside of the first opening for receiving page tab means to provide tab means to engage a binder or the like supported on the legs.

21. A stand as claimed in claim 20 wherein the second opening for receiving cover tab means is disposed outside of the second opening for receiving page tab means to provide tab means to engage a binder or the like supported on the legs.

22. A stand as claimed in claim 1, in which:

(a) circular openings in the bottom plate are generally aligned with each other and are disposed parallel to a side edge, front edge or rear edge of said bottom plate.

* * * * *